United States Patent [19]

Shibata et al.

[11] Patent Number: 4,641,116

[45] Date of Patent: Feb. 3, 1987

[54] MICROWAVE FILTER

[75] Inventors: Junichi Shibata; Hiroshi Kojima, both of Saitama, Japan

[73] Assignee: Pioneer Ansafone Manufacturing Corporation, Saitama, Japan

[21] Appl. No.: 801,995

[22] Filed: Nov. 25, 1985

[30] Foreign Application Priority Data

Nov. 28, 1984 [JP] Japan ..... 59-249758

[51] Int. Cl.[4] ..... H01P 1/203; H01P 7/08

[52] U.S. Cl. ..... 333/204; 333/202; 333/219; 333/246

[58] Field of Search ..... 333/202, 204, 205, 219, 333/222, 246, 223, 235; 331/96, 101, 107 SL

[56] References Cited

U.S. PATENT DOCUMENTS 4,185,252 1/1980 Gerlach ..... 333/219 X

OTHER PUBLICATIONS

Ronde and Shammas—"MIC Bandfilters Using Open—Ring Resonators", 4th European Microwave Conference, Montreux, Switzerland (Sep. 10–13, 1974); pp. 531–535.

*Primary Examiner*—Marvin L. Nussbaum

*Attorney, Agent, or Firm*—Sughrue, Mion, Zinn, Macpeak and Seas

[57] ABSTRACT

A microwave bandpass filter having a wide bandwidth, low loss, and yet which requires only a relatively small circuit area. A generally annularly shaped unit-wavelength resonator is formed on a dielectric substrate, disposed between input and output matching circuits. The unit-wavelength resonator is formed by a pair of semi-annular strips disposed opposite one another and having opposing stubs defining therebetween a gap of predetermined width.

5 Claims, 6 Drawing Figures

MICROWAVE FILTER

BACKGROUND OF THE INVENTION

The present invention relates to a microwave bandpass filter provided with a resonator having line patterns formed on a substrate.

Conventionally, microwave filters have been constructed as shown in FIGS. 1 and 2.

FIG. 1 shows a microwave filter formed with line patterns including an input line 11, a pair of half-wavelength resonators 12, and an output line 13. A geometrical feature of the microwave filter of this type is that the half-wavelength resonators 12 are disposed between the input and output lines 11 and 13 and extend parallel to one another. A microwave signal applied through the input line 11 causes the pair of half-wavelength resonators 12 to resonate so as to produce electric power at a desired frequency upon the output line 13.

In the microwave filter of this type, however, there are disadvantages that a relatively large area is required for the respective line patterns of the input line 11, the half-wavelength resonators 12, and the output line 13 on the substrate, and a large number of stages are required in order to make sufficiently wide the bandwidth of the microwave filter, resulting in a large loss.

FIG. 2 shows another microwave filter provided with an input line 21, a pair of half-wavelength annular resonators 22, and an output line 23. A microwave filter of this type is disclosed, for example, in Japanese Patent Publication No. 7721/1980. In this filter, the pair of half-wavelength resonators 22 disposed between the input and output lines 21 and 23 are geometrically configured such that a pair of annular strip lines each having a gap G are arranged so as to form respective gaps G in opposition to each other. The function of the microwave filter of FIG. 2 is the same as that of FIG. 1.

In the microwave filter of the type shown in FIG. 2, although it is possible to reduce the area occupied by the line patterns, there are still disadvantages that it is difficult to make the bandwidth of the filter sufficiently wide and that there is a considerable amount of loss (fractional bandwidth of several percent).

SUMMARY OF THE INVENTION

An object of the present invention is therefore to eliminate the foregoing disadvantages in the prior art microwave filter.

Another object of the present invention is to provide a wide-bandwidth, low-loss microwave filter having a compact circuit arrangement.

The above and other objects, features, and advantages of the present invention will become more apparent by reference to the following description taken in conjunction with the accompanying drawings.

DESCRIPTION OF THE PREFERRED EMBODIMENTS

Figure 1:
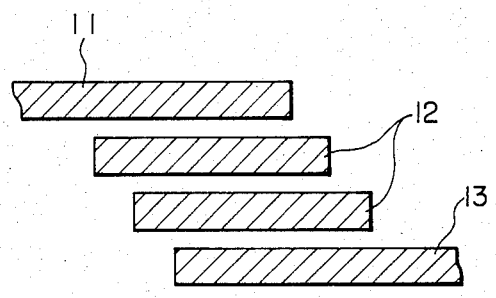
FIG. 1 PRIOR ART
FIGS. 1 and 2 are plan views showing line patterns of respective conventional microwave filters.
Figure 2:
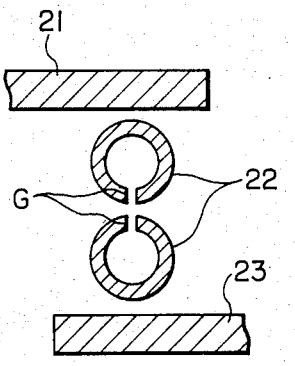
FIG. 2 PRIOR ART

Referring to FIGS. 3 to 6 of the drawings, examples of the present invention will be specifically described hereunder. FIGS. 3 to 6 are plan views showing line patterns of microwave filters of respective embodiments of the present invention.

In each of FIGS. 3 to 6, there are provided an input matching circuit 1, a unit-wavelength (λ) resonator 2 constituted by a pair of semi-annular or U-shaped strip lines 2A and 2B disposed opposite each other, and an output matching circuit 3.

In this filter, important features are that the unit-wavelength resonator 2 disposed between the input and output matching circuits 1 and 3 is constituted by the pair of semi-annular strip lines 2A and 2B disposed opposite each other, and that the strip lines 2A and 2B are provided with stubs or protrusions at portions opposite each other to form therebetween a gap having a predetermined width.

The center frequency of the bandpass filter is determined by the unit-wavelength resonator 2, while the passband thereof is determined by the width of the gap S and the projecting length of the stubs T.

The stubs T can be used for finely adjusting the center frequency.

With this arrangement, a microwave filter having a fractional bandwidth of about 15% and an insertion loss of about 1 dB, for example, in the 4 GHz band, is obtained.

Figure 3:
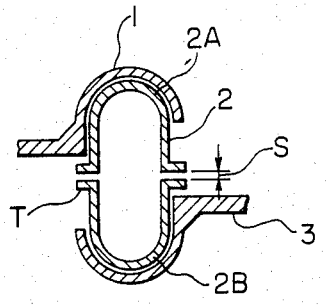
FIGS. 3 to 6 are plan views showing line patterns of microwave filters of respective embodiments of the present invention.
Figure 4:
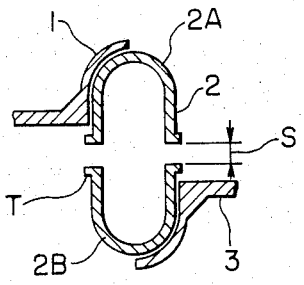

FIG. 4 shows a microwave filter of a relatively narrow bandwidth (the fractional bandwidth is about 5%). In the microwave filter of FIG. 4, the projecting length of the stubs T and the width of the gap S are selected to be shorter and larger, respectively, than those in the microwave filter of FIG. 3. Further, the length of each of the input and output matching circuits 1 and 3 is made shorter than that in the case of FIG. 3.

Figure 5:
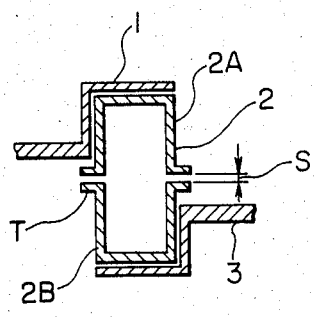
Figure 6:
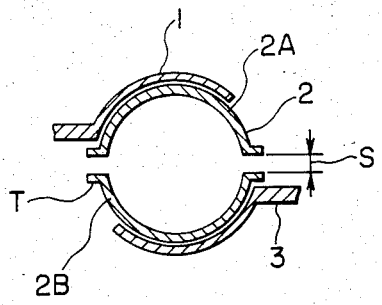

Although the shape of the unit-wavelength resonator 2 loop is elliptical in the microwave filters of FIGS. 3 and 4, it may alternatively be rectangular, as shown in FIG. 5, or circular, as shown in FIG. 6.

As described above, according to the present invention, a unit-wavelength resonator is used, and therefore it is possible to realize a wide-bandwidth, low-loss microwave filter with a relatively compact circuit arrangement. Further, the center frequency of the filter can easily be finely adjusted by adjusting the length of the stubs.

We claim:

1. A passive microwave bandpass filter, comprising:

(a) a dielectric substrate;

(b) an input matching circuit (1) disposed on the substrate, (c) an output matching circuit (3) disposed on the substrate and having an end portion spaced from an end portion of the input matching circuit, and (d) a unit-wavelength resonator (2) disposed between said end portions of the input and output matching circuits, (e) said unit-wavelength resonator comprising a pair of generally U-shaped strip lines (2A, 2B) disposed opposite each other with ends facing but spaced from each other across equal width gaps (5) to define an otherwise closed loop, and said strip line ends having outwardly extending, parallel stubs (T) defining therebetween said gaps, the width of said gaps and the outwardly extending length of said stubs determining the passband of the filter.

2. The filter of claim 1, wherein the end portions of the matching circuits at least partially embrace central portions of the strip lines and are matingly configured thereto.

3. The filter of claim 2, wherein the closed loop defined by said resonator is substantially elliptical in shape.

4. The filter of claim 2, wherein the closed loop defined by said resonator is substantially rectangular in shape.

5. The filter of claim 2, wherein the closed loop defined by said resonator is substantially circular in shape.

* * * * *